US007501228B2

(12) United States Patent
Sexton et al.

(10) Patent No.: US 7,501,228 B2
(45) Date of Patent: Mar. 10, 2009

(54) ANNULAR NOZZLE STRUCTURE FOR HIGH DENSITY INKJET PRINTHEADS

(75) Inventors: Richard W. Sexton, Bainbridge, OH (US); James E. Harrison, Jr., Dayton, OH (US); Jeanine A. Clark, Yellow Springs, OH (US); Margene C. Howell, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 903 days.

(21) Appl. No.: 11/076,593

(22) Filed: Mar. 10, 2005

(65) Prior Publication Data

US 2006/0203036 A1 Sep. 14, 2006

(51) Int. Cl.
*B41J 2/16* (2006.01)

(52) U.S. Cl. ..... 430/320; 205/75

(58) Field of Classification Search ..... None
See application file for complete search history.

(56) References Cited

U.S. PATENT DOCUMENTS 4,184,925 A 1/1980 Kenworthy
4,528,577 A 7/1985 Cloutier et al.
4,971,665 A 11/1990 Sexton
6,022,752 A * 2/2000 Hirsh et al. ..... 438/21
6,586,112 B1 * 7/2003 Te ..... 428/596

FOREIGN PATENT DOCUMENTS

JP 4-142940 A * 5/1992
WO 2005/014292 2/2005

* cited by examiner

*Primary Examiner*—John A. McPherson
(74) *Attorney, Agent, or Firm*—Buskop Law Group PC

(57) ABSTRACT

A method for fabricating an orifice plate with high density arrays of nozzles entails disposing a photoresist layer on a glass with a metalized layer forming a photomask blank and patterning the photomask blank with one or more openings. Second openings are formed by etching through the initial openings into the photoresist layer. The photoresist layer is removed and a second photoresist layer is added to the formed patterned structure forming a mandrel. One or more rings are patterned onto the mandrel. Each ring has an outer diameter larger than the diameter of the second openings and an inner diameter smaller than the diameter of the second openings. The mandrel with formed rings is plated with a metal forming an orifice plate. The orifice plate is separated from the patterned mandrel, forming an orifice plate with a high density array of nozzles.

18 Claims, 12 Drawing Sheets

ANNULAR NOZZLE STRUCTURE FOR HIGH DENSITY INKJET PRINTHEADS

FIELD OF THE INVENTION

The present embodiments relate generally to electroformed orifice plates for high density ink jet printers.

BACKGROUND OF THE INVENTION

Many different techniques and combinations of materials have been used for making small diameter nozzles for ink jet printers. Punching, laser drilling, molding, and machining have been reported as methods for making ink jet nozzles. One of the most useful and economical methods for making small holes, especially where hundreds of jets in an array are required, is by electroforming around or over small dielectric cylinders, or posts, formed of photo-imaged resist polymer. This geometry is described in numerous patents related to methods for making orifice plates, such as Kenworthy U.S. Pat. No. 4,184,925; Cloutier U.S. Pat. No. 4,528,577; and Sexton U.S. Pat. No. 4,971,665.

A need exists for smooth over plated nozzles at very close spacing for high density arrays (i.e., greater than 300 jets/inch). The problem is that the electroplating grows in thickness at nearly the same rate that the electroplating grows laterally over the dielectric post. If the posts are necessarily very small in diameter because of the close spacing, the resultant thickness of nickel is very small. For example, at jet density of 600 dpi and an orifice diameter of 0.0006 inch, the plating thickness is practically limited to 0.0005 inch thickness when plating over 0.0016 inch diameter posts. Foils at this thickness are fragile and subject to distortion during handling and use.

The present invention meets this need and provides a high density array by this method.

SUMMARY OF THE INVENTION

Embodied herein is a method for fabricating an orifice plate with a high density array of nozzles. The method begins by disposing a photoresist layer on a glass with a metalized layer forming a photomask blank and then patterning the photomask blank with one or more openings in the photoresist layer forming a patterned photomask blank. One or more second openings are formed by the first openings into the photoresist layer, thereby forming an etched blank. The photoresist layer is removed from the etched blank forming a patterned structure.

The method continues by applying a second photoresist layer to the patterned structure forming a mandrel. The mandrel is patterned to form one or more rings over each second opening. Each ring has an outer diameter larger than the diameter of the second opening and an inner diameter smaller than the diameter of the second opening forming a patterned mandrel. The patterned mandrel is plated with a metal to form an orifice plate. The orifice plate is separated from the patterned mandrel forming an orifice plate with a high density array of nozzles.

The present embodiments are advantageous over the prior art because the methods provide an array resistant to mechanical distortion.

BRIEF DESCRIPTION OF THE DRAWINGS

In the detailed description of the preferred embodiments presented below, reference is made to the accompanying drawings, in which.

Figure 1:
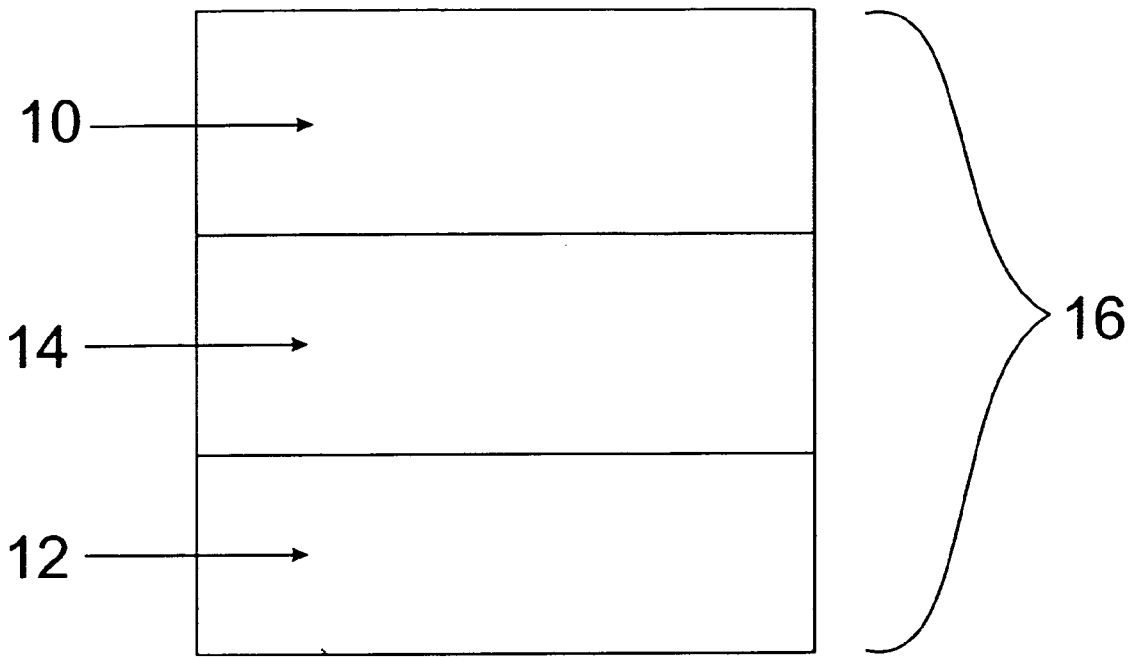
FIG. 1 depicts a photomask blank formed during an embodiment of the method.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The present embodiments relate to a novel nozzle structure that permits close spacing of electroformed nozzles made with a thin layer of metal. By over-plating a dielectric ring, the corresponding fabricated high density arrays, of up to 600 nozzles per inch, for orifices are structurally stronger and more uniform than the nozzle structures in the current art. The methods enable the printing to occur at higher operating frequencies.

Uniform nozzle structures provide a benefit of maintaining ink jets that print in a straight line.

The embodied annular ring nozzle designs and methods herein overcomes the fragility issue that occur in the prior art by providing high aspect nozzles with the preferred smooth transition for jet stability.

The embodied methods produce a nozzle shape with an increased length for the ink jets emanating from the nozzles. The increased length is because the ring structure provides greater control over small diameter nozzles. The recess formed at the exit of the nozzles help to control the meniscus diameter of the jet coming from the nozzle, thereby creating straighter jets and, therefore, higher print quality.

An embodiment of a method for fabricating an orifice plate with a high density array of nozzles begins by disposing a first photoresist layer on a glass with a metalized layer, thereby forming a photomask blank. The first photoresist layer is typically phenol formaldehyde resin, such as Model 1813 Novolac™ resin from Shipley, of Marlboro, Mass. The first photoresist layer is added at a thickness from about 1 micrometer to about 5 micrometers. The glass on which the first photoresist layer is added is typically a soda lime glass. The metalized layer is conductive metal. Preferred examples of metals are chromium, molybdenum, titanium, tungsten, aluminum, alloys thereof, and combinations thereof.

One or more openings are patterned into the first photoresist layer located on the photomask blank. Typically, the density of openings patterned onto the photomask blank ranges from one opening per inch to about 600 openings per inch. Each opening has a first diameter ranging from about 10 micrometers to about 50 micrometers.

The method continues by etching through the first openings into the first photoresist layer to form one or more second openings in the metalized layer, thereby forming an etched blank. The diameter of the second opening is substantially equivalent to the diameter of the first openings. The second openings can be etched using either dry chemical etching or wet chemical etching.

The first photoresist layer is removed from the etched blank, thereby forming a patterned structure. The first openings are removed when the first photoresist layer is removed. The first photoresist layer can be removed by dissolving, plasma ashing, laser ablation, and combinations thereof. If the first photoresist layer is removed by dissolving, a solvent, such as acetone, methylethylketone, methylene chloride, or cyclopentanone, is typically used.

A second photoresist layer is added to the patterned structure, thereby forming a mandrel. The second photoresist layer is preferably an epoxy, such as Model SU8 available from Microchem in Newton Mass. The second photoresist layer is added at a thickness ranging from about 10 micrometer to about 50 micrometers. The second photoresist layer is preferably added at a thickness greater than the first photoresist layer.

The method continues by patterning the mandrel forming at least one ring over each second opening. Each formed ring comprises an outer diameter larger than the diameter of the second opening and an inner diameter smaller than the diameter of the second opening. The rings can be formed in numerous shapes, such as circular, ellipsoid, and polygons. The rings are preferably formed so that all of the rings have the same shape. The rings can be patterned onto the mandrel using a radiation source to cure the second photoresist layer through a photomask or by projecting a pattern onto the second photoresist layer.

The mandrel with the patterned rings is plated with a metal to form an orifice plate. Examples of usable metals to plate the mandrel include nickel, gold, copper, alloys thereof, and combinations thereof.

The method ends by separating the orifice plate from the patterned mandrel. The formed orifice plate comprises a high density array of nozzles. The orifice plate is typically removed from the mandrel by peeling, thermal shock, or other mechanical separation.

An example of embodied method entails the formation of a ring shaped precursor or mandrel, upon which the electroformed annular nozzle is plated. Formation of the mandrel involves first imaging and etching an opening in a chromium photomask blank, such as provided by the Hoya Company, Japan. In this example, a chrome blank with the etched openings is stripped of the photoresist layer and, then, recoated with positive or negative resist layer. The coating of positive or negative resist layers is done using a thickness from about 10 micrometer to 50 micrometers. A photomask with ring shaped images is then aligned precisely over the etched openings in the chromium layer. The rings are imaged using ultraviolet light exposure and developed in a suitable solution. The resultant rings are then plated with a metal. The formed orifice plate is then removed from the mandrel and the second photoresist layer is removed with acetone. The second photo resist layer can remain in the structure and a usable orifice plate can still be produced.

The embodied orifice plate formed from a plated patterned mandrel has a high density array of nozzles. The orifice plate includes a metalized layer. The metalized layer has one or more openings. The orifice plate includes a ring of dielectric material disposed internally in the metalized layer. Each ring has an outer diameter larger than the diameter of each opening and an inner diameter not larger than the diameter of each opening.

With reference to the figures, FIG. 1 depicts a photomask blank 16 with a glass 12, a metalized layer 14, and a photoresist layer 10.

Figure 2:
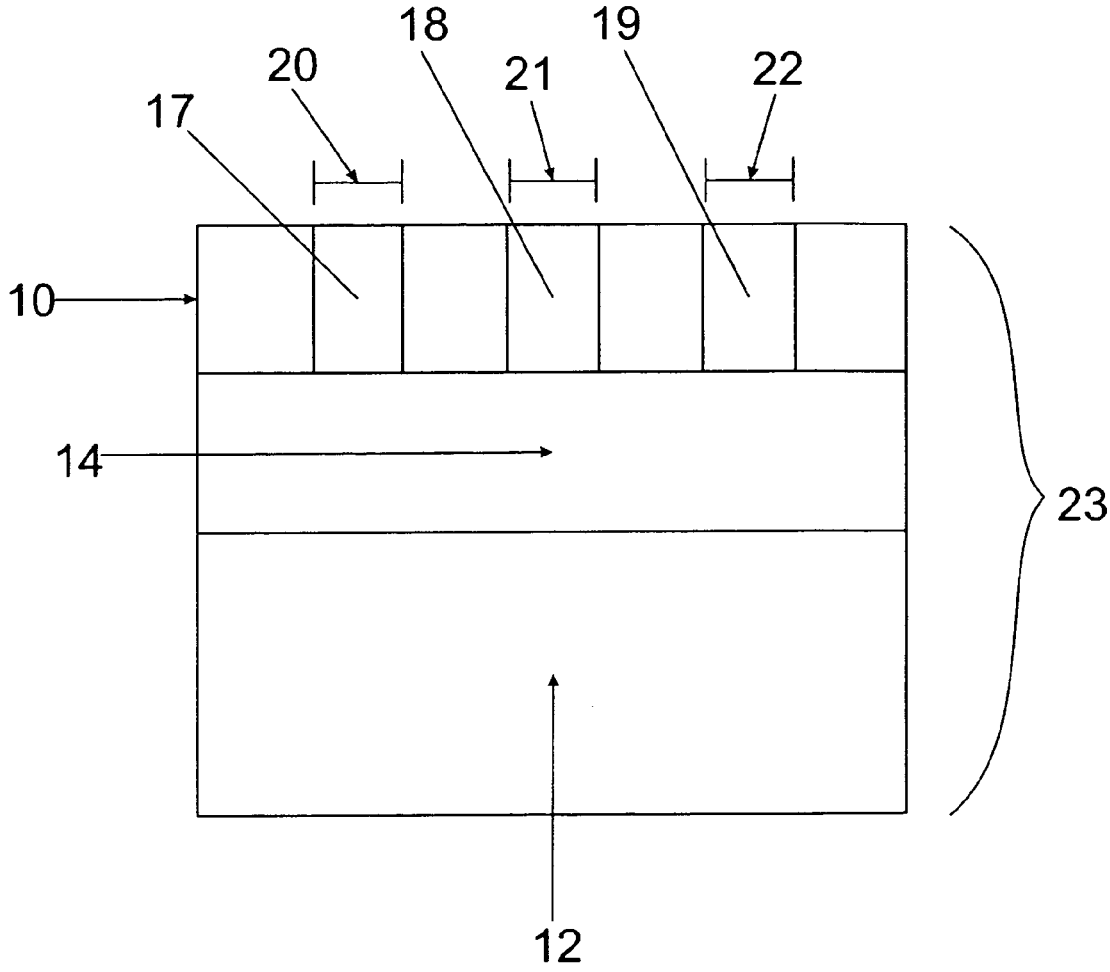
FIG. 2 depicts a patterned photomask blank formed during an embodiment of the method.

FIG. 2 is a patterned photomask blank 23 with a first photoresist layer 10, a metalized layer 14, and first openings 17, 18, and 19. Each opening 17, 18, and 19 has a first diameter 20, 21 and 22, depicted as 30 micrometer diameters in the figure. The openings 17, 18 and 19 project through the photoresist layer 10 to the metalized layer 14. The openings 17, 18, and 19 can be an array up to 600 openings per inch. In the embodiment shown in FIG. 2, the array is contemplated for 600 openings per inch of the photomask blank 23. In a preferred embodiment, the patterning to form the patterned structure is performed by exposing the photomask blank 23 to ultraviolet radiation. The time period of radiation exposure is typically between 5 seconds and 15 seconds; however, the time is dictated by the thickness of the photoresist layer 10 and the type of photoresist material being used.

Figure 3:
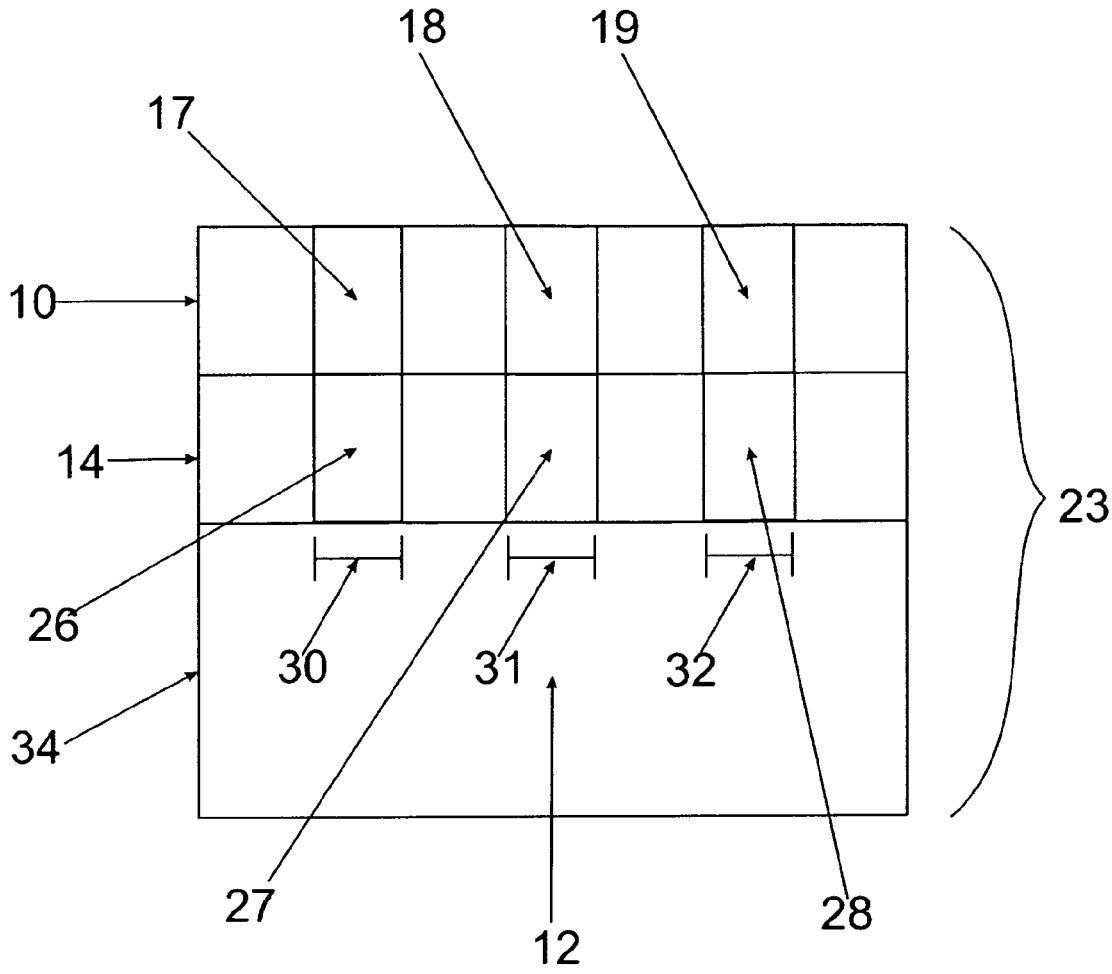
FIG. 3 depicts an etched blank formed during an embodiment of the method.

FIG. 3 depicts a formed etched blank 34 with a glass 12, a metalized layer 14, a first photoresist layer 10, first openings 17, 18, and 19 and second openings 26, 27, and 28. Each second opening 26, 27, and 28 has a second diameter 30, 31, and 32. The second openings 26, 27, and 28 are etched through the metalized layer 14. In the most preferred embodiment, the glass is soda lime glass with a metalized layer of chromium. The most preferred way of etching is by immersion of the patterned photomask blank 23 in a chromium etchant.

Figure 4:
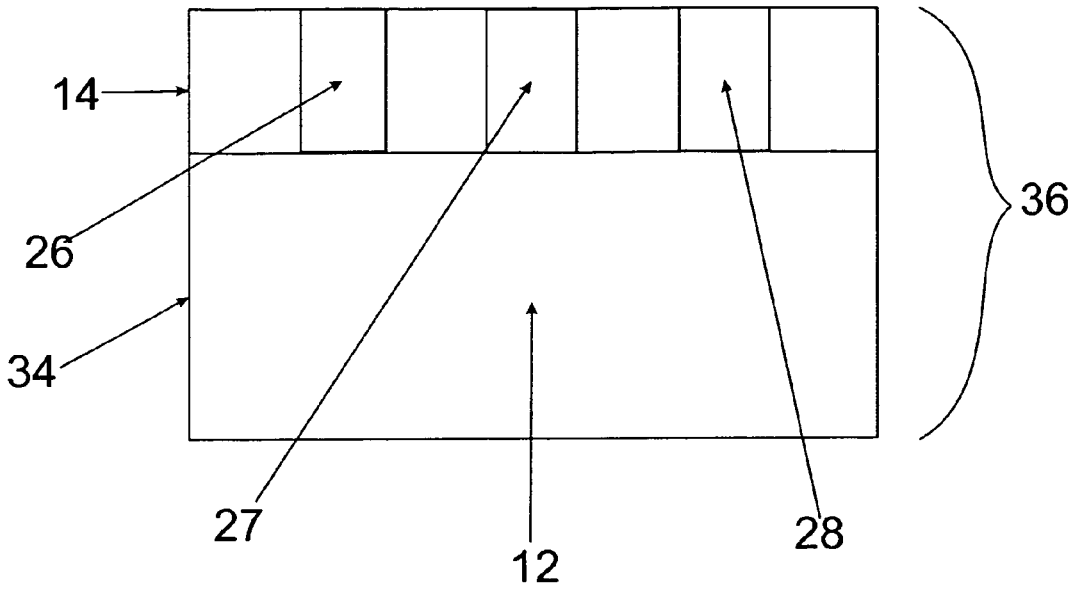
FIG. 4 depicts a patterned structure formed during an embodiment of the method.
Figure 5:
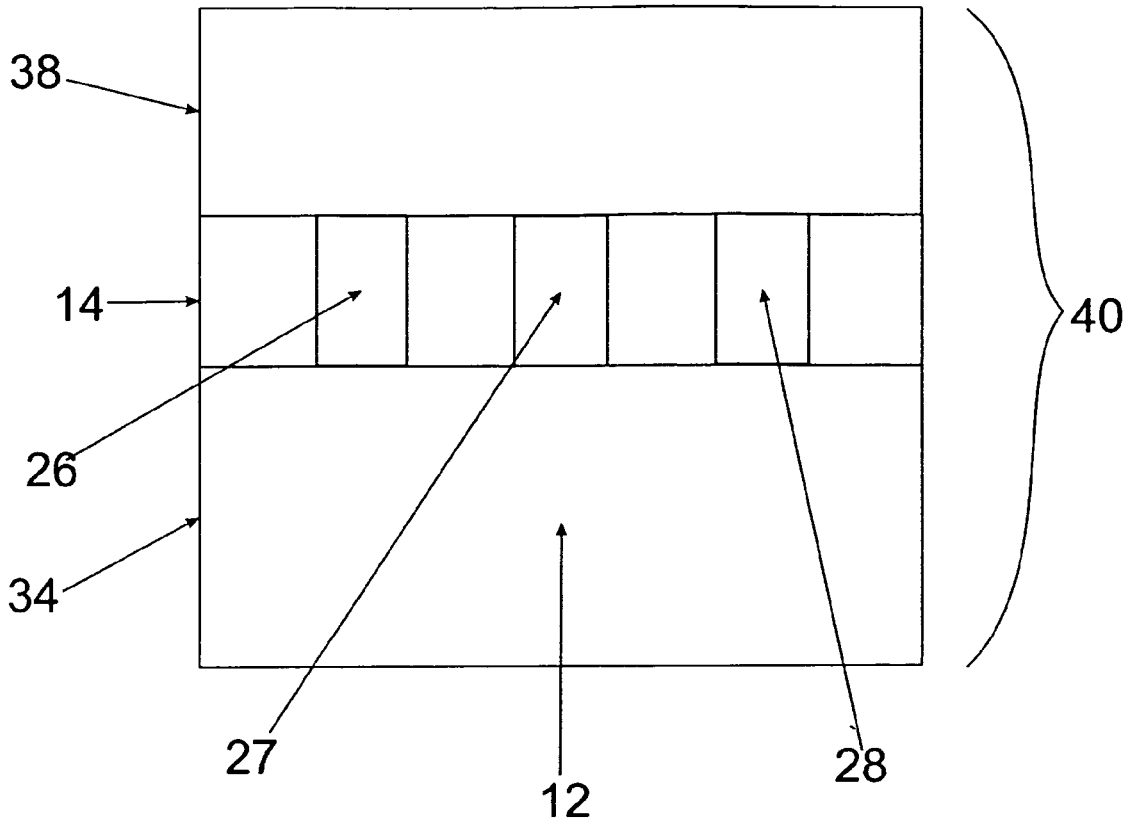
FIG. 5 depicts a mandrel formed during an embodiment of the method.

FIG. 4 depicts a formed patterned structure 36 having glass 12, a metalized layer 14, and second openings 26, 27, and 28 projecting through the metalized layer 14. FIG. 5 depicts the formed mandrel 40 with a glass 12, a metalized layer 14, second openings 26, 27, and 28, and a second photoresist layer 38 disposed thereon.

Figure 6:
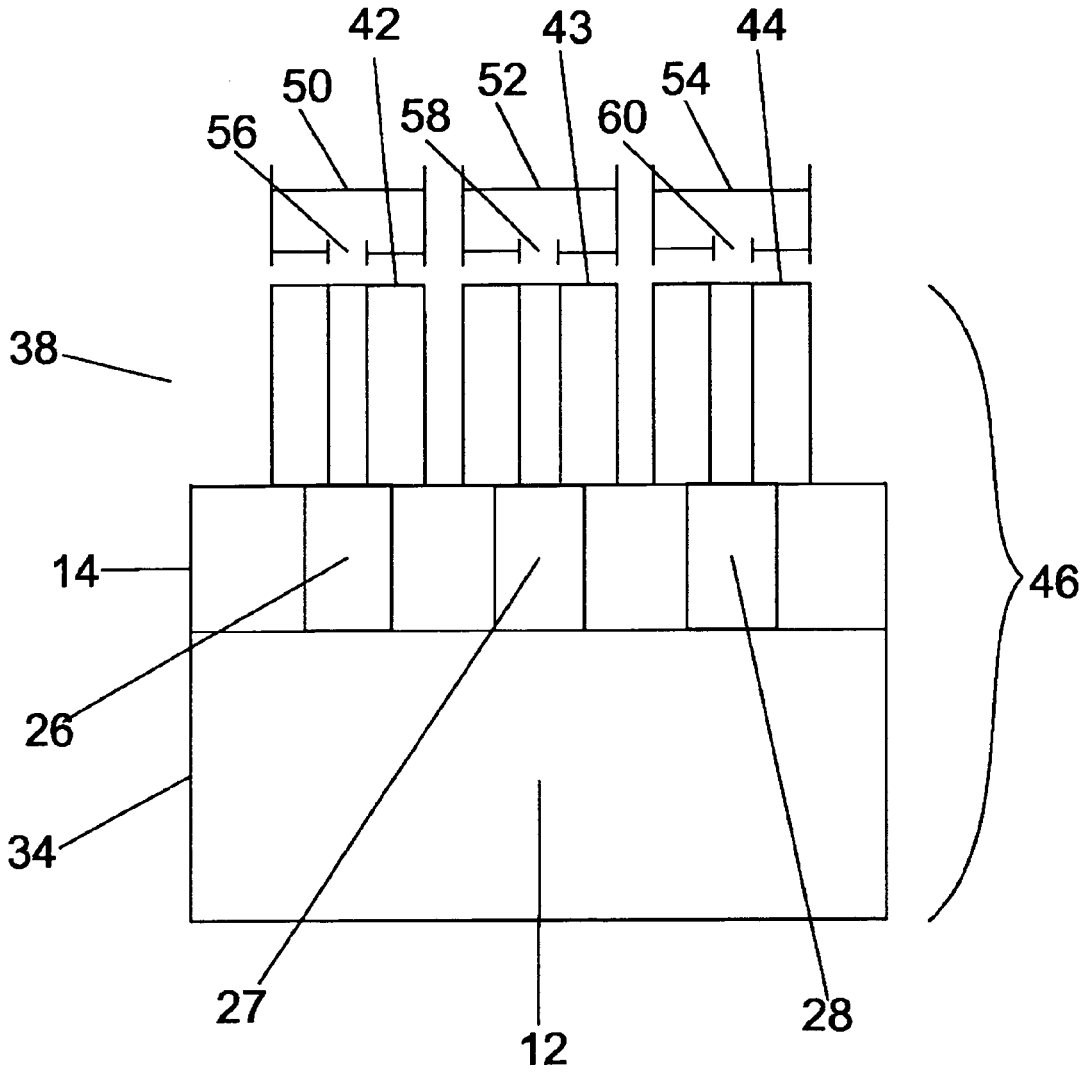
FIG. 6 depicts a patterned mandrel formed during an embodiment of the method.

FIG. 6 is a formed patterned mandrel 46 with a glass 12, a metalized layer 14 with second openings 26, 27, and 28 with rings 42, 43, and 44. The rings 42, 43, and 44 have outside diameters 50, 52 and 54 respectively, and inner diameters 56, 58 and 60 respectively. In the most preferred embodiment, the inner diameter of the ring, depicted as 25 micrometers, are smaller than the diameters of the second openings 26, 27, and 28, depicted as 30 micrometers. In the most preferred embodiment, the outer diameters 50, 52, and 54 are contemplated to be 40 micrometers.

Figure 7:
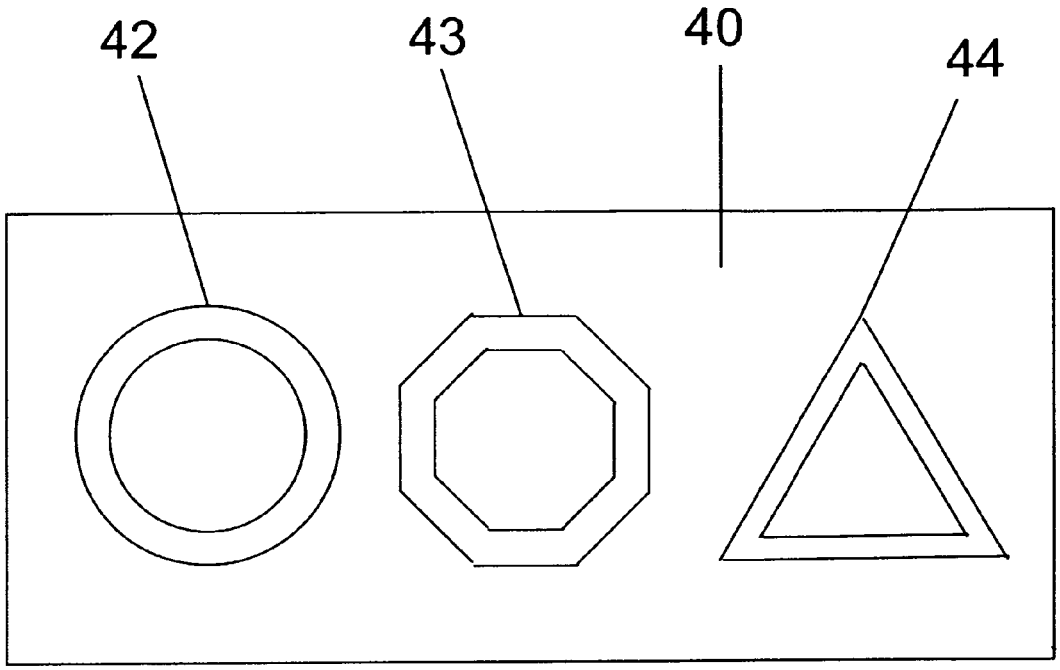
FIG. 7 details a patterned mandrel with rings of three different shapes formed during an embodiment of the method.

FIG. 7 shows three different geometric shapes that can be used to form the rings. Ring 42 is a circular shape. Ring 43 is a hexagonal shape. Ring 44 is a triangular; however, many other geometric shapes are contemplated. The rings 42, 43, and 44 can all be the same shape, or the rings 42, 43, and 44 can be groups of different shapes. The rings 42, 43, and 44 can alternate one shape, being for example a square and then having an adjacent different shape, such as a circle. A first group of rings can all be a hexagonal shape, and then a second group of rings can be a different shape, such as triangles. Some rings can be larger or smaller than other rings, as long as the dimensions of the ring are maintained. Some rings can have a shape such that the structure is longer in one direction than in another direction, such as a rectangle or an elliptic shape. If the ring is longer at one axis, the rings can be ordered to be parallel to the array of jets or perpendicular to the array of jets. The most preferred shape of the rings 42, 43, and 44 is circular.

Figure 8:
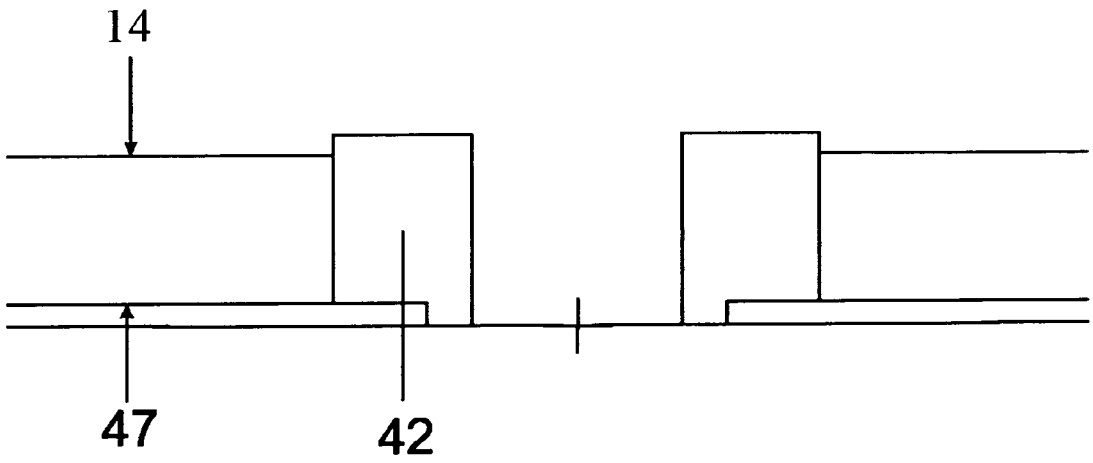
FIG. 8 depicts an initial stage of metal deposition on a ring.

FIG. 8 shows the initial stage of metal deposition by electroforming on the mandrel. As shown in the figure, the metal 47 plates up on the metalized layer 14. The deposited metalized layer 14 is not yet as tall as the ring 42.

Figure 9:
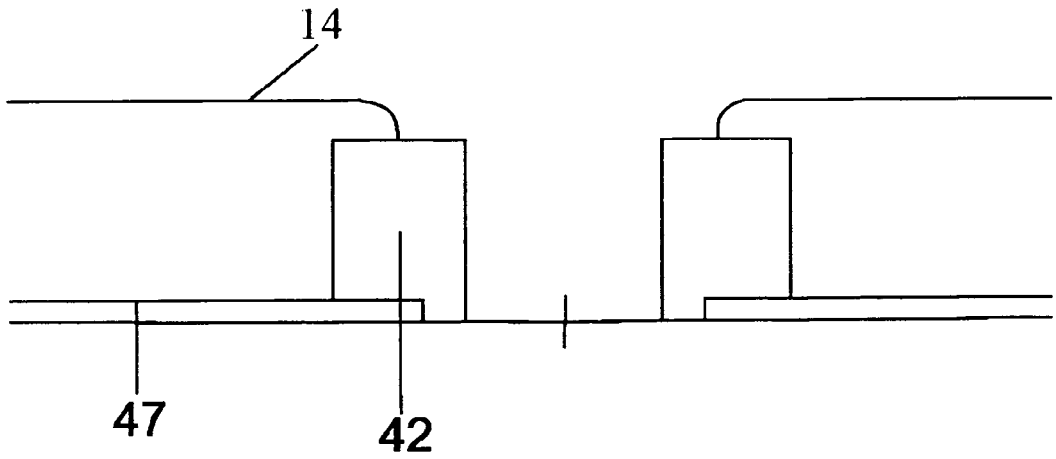
FIG. 9 depicts an intermediate stage of metal deposition on a ring.

FIG. 9 shows an intermediate stage of metal 47 being deposited on the mandrel. Once the metalized layer 14 thickness exceeds the height of the ring 42, the metal 47 can begin to plate over the top of the ring 42.

Figure 10:
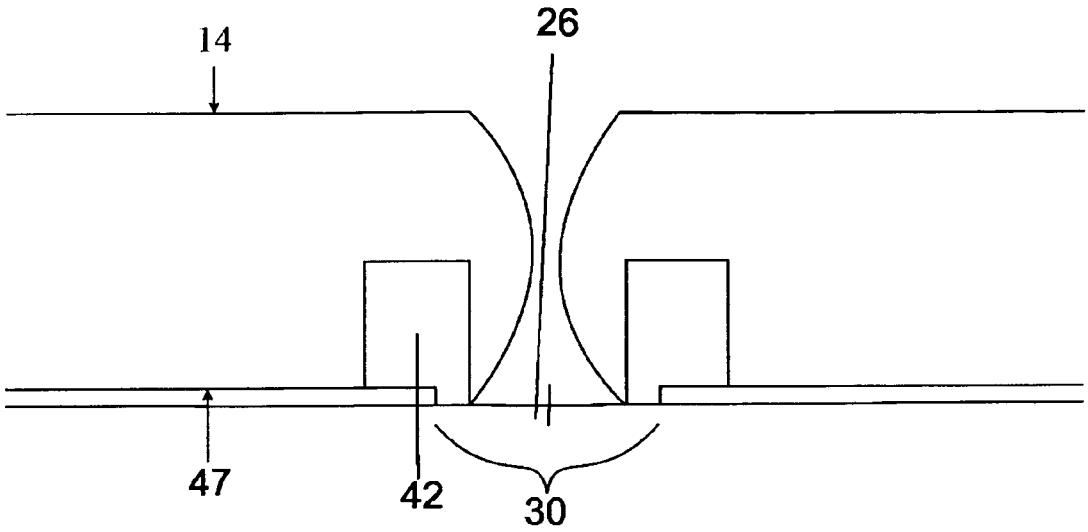
FIG. 10 depicts a final stage of metal deposition on a ring.

FIG. 10 shows a final stage of metal deposition on the mandrel. After the metalized layer 14 has plated over the top of the ring 42 from the outer edge to the inner edge of the ring 42, the metal 47 begins to plate down the inner wall of the ring. The metal continues to plate down the inside of the ring until as shown in FIG. 10, the metal 47 has plated down the inner wall of the ring all the way to the surface of the mandrel. This method produces a nozzle or an opening 26 with an hour glass profile. Furthermore, by varying the ring height, inside diameter, and outside diameter, the orifice profile can be varied, if desired.

Figure 11:
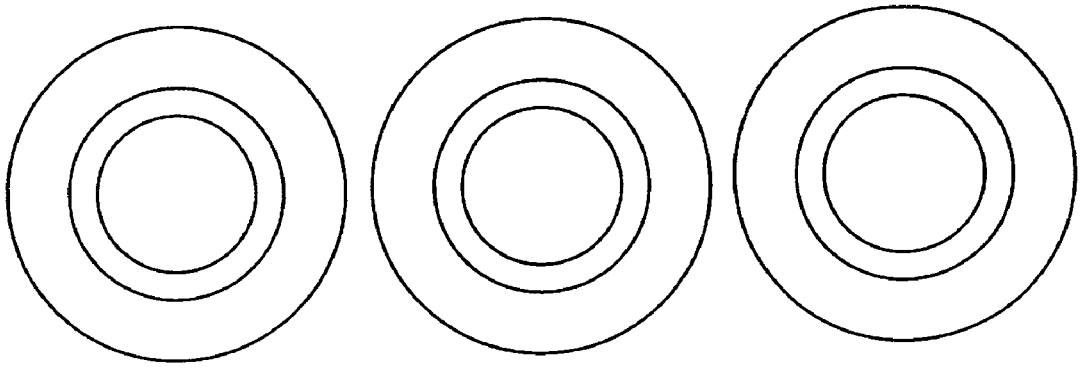
FIG. 11 is a micrograph of a portion of an orifice plate formed by the method embodied herein.
Figure 12:
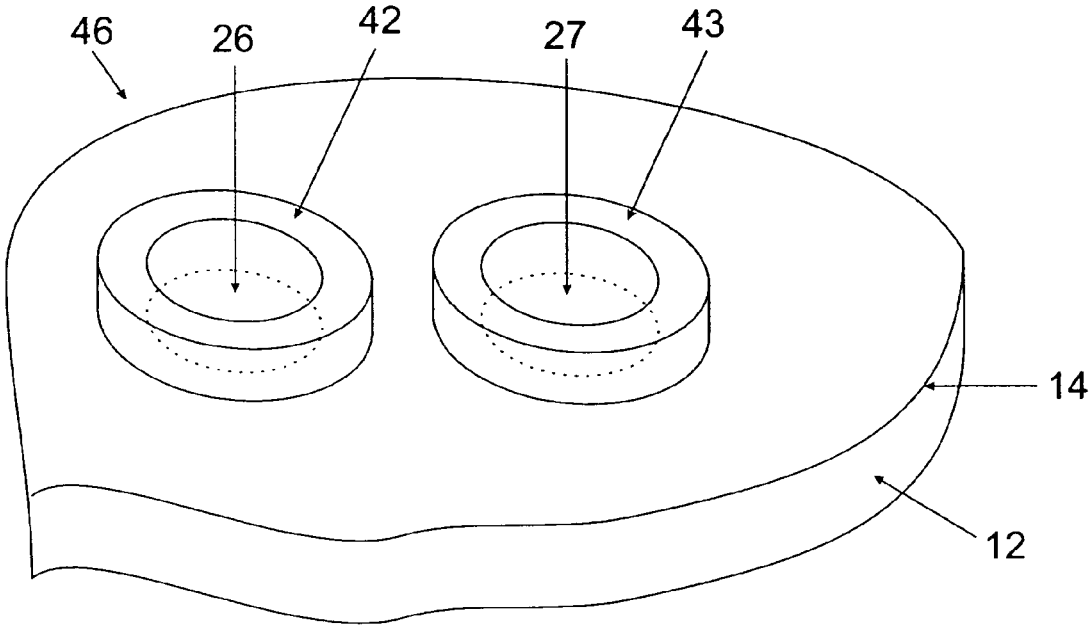
FIG. 12 depicts an isometric view of a patterned mandrel as depicted in FIG. 6.

FIG. 11 is a micrograph depicting the annular structure produced on the mandrel. FIG. 12 is an isometric view of FIG. 6. Two rings 42 and 43 are shown on a patterned mandrel 46.

Tests have shown that the embodied methods can produce jet arrays at 600 jets per inch; the jets tested straight to +/−1 milliradian. Testing demonstrated that the jets were uniform and stable.

The long length-to-diameter ratio (aspect ratio) of the nozzles formed by the annular plating process provides better jet stability than are obtained with known methods of making orifice plates with nozzles by plating over posts. In addition, the velocity variation of the resultant jets is much lower than with simple straight wall nozzle structures made by known electroplating.

The invention has been described in detail with particular reference to certain preferred embodiments thereof, but it will be understood that variations and modifications can be effected within the spirit and scope of the invention.

PARTS LIST

10. first photoresist layer
12. glass
14. metalized layer
16. photomask blank
17. first opening
18. first opening
19. first opening
20. first diameter
21. first diameter
22. first diameter
23. patterned photomask blank
26. second opening
27. second opening
28. second opening
30. second diameter
31. second diameter
32. second diameter
34. etched blank
36. patterned structure
38. second photoresist layer
40. mandrel
42. ring
43. ring
44. ring
46. patterned mandrel
47. metal
50. outer diameter of ring
52. outer diameter of ring
54. outer diameter of ring
56. inner diameter of ring
58. inner diameter of ring
60. inner diameter of ring The invention claim is:

1. A method for fabricating an orifice plate with a high density array of nozzles, wherein the method comprises the steps of a. disposing a first photoresist layer (10) on a glass (12) with a metalized layer (14) forming a photomask blank (16);

b. patterning the photomask blank (16) with at least one first opening (17, 18, and 19) in the first photoresist layer (10) forming a patterned photomask blank (23), wherein each first opening (17, 18, and 19) comprises a first diameter (20, 21, and 22);

c. etching through the first openings (17, 18, and 19) into the first photoresist layer (10) forming at least one second opening (26, 27, and 28) in the metalized layer (14) forming an etched blank (34), wherein each second opening (26, 27, and 28) comprises a second diameter (30, 31, and 32);

d. removing the first photoresist layer (10) from the etched blank (34) forming a patterned structure (36);

e. applying a second photoresist layer (38) to the patterned structure (36) forming a mandrel (40);

f. patterning the mandrel (40) forming at least one ring (42, 43, and 44) over each second opening (26, 27, and 28), wherein each ring (42, 43, and 44) comprises an outer diameter larger than the second diameter (30, 31, and 32) and an inner diameter smaller than the second diameter (30, 31, and 32) forming a patterned mandrel (46);

g. plating the patterned mandrel (46) with a metal (47) forming an orifice plate on the patterned mandrel (46); and h. separating the orifice plate from the patterned mandrel (46), wherein the orifice plate comprises a high density array of nozzles.

2. The method of claim 1, wherein the step of disposing the first photoresist layer on a glass disposes the first photoresist layer at a thickness from about 1 micrometer to about 5 micrometers.

3. The method of claim 1, wherein the first photoresist layer is a phenol formaldehyde resin.

4. The method of claim 1, wherein the glass is soda lime glass.

5. The method of claim 1, wherein the metalized layer is selected from the group consisting of chromium, molybdenum, titanium, tungsten, aluminum, alloys thereof, and combinations thereof.

6. The method of claim 1, wherein the step of patterning the photomask blank with at least one first opening patterns between 1 opening per inch and 600 openings per inch onto the photomask blank.

7. The method of claim 1, wherein the first diameter is from about 10 micrometers to about 50 micrometers.

8. The method of claim 1, wherein the first diameter is substantially equivalent to the second diameter.

9. The method of claim 1, wherein the step of etching through the first openings is performed by dry chemical etching or wet chemical etching.

10. The method of claim 1, wherein the step of removing the first photoresist layer is performed by dissolving the first photoresist layer with a solvent selected from the group consisting of acetone, methylethylketone, methylene chloride, and cyclopentanone.

11. The method of claim 1, wherein the step of applying the second photoresist layer disposes the second photoresist layer at a thickness from about 10 micrometer to about 50 micrometers.

12. The method of claim 1, wherein the step of applying the second photoresist layer disposes the second photoresist layer at a thickness greater than the first photoresist layer.

13. The method of claim 1, wherein the second photoresist layer is an epoxy.

14. The method of claim 1, wherein the step of patterning the mandrel creates rings that are the same shape to every other ring on the mandrel.

15. The method of claim 1, wherein the step of patterning the mandrel creates rings with a shape selected from the group consisting of circular, ellipsoid, and polygons.

16. The method of claim 1, wherein the step of patterning the mandrel is performed using a radiation source to cure the second photoresist layer through a photomask or by projecting a pattern onto the second photoresist layer.

17. The method of claim 1, wherein the step of plating the patterned mandrel with the metal utilizes the metal selected from the group consisting of nickel, gold, copper, alloys thereof, and combinations thereof.

18. The method of claim 1, wherein the step of separating the orifice plate from the patterned mandrel is performed by peeling, thermal shock, or other mechanical separation.

* * * * *